United States Patent [19]

Fukuchi et al.

[11] 4,451,134

[45] May 29, 1984

[54] MAGNETIC-BRUSH DEVELOPING DEVICE

[75] Inventors: Masakazu Fukuchi, Hachioji; Keiji Oishi, Hino; Yoshio Yamazaki, Mizuho, all of Japan

[73] Assignee: Konishiroku Photo Industry Co., Ltd., Tokyo, Japan

[21] Appl. No.: 447,883

[22] Filed: Dec. 8, 1982

[30] Foreign Application Priority Data

Dec. 18, 1981 [JP] Japan ..... 56-203622
Dec. 18, 1981 [JP] Japan ..... 56-203623

[51] Int. Cl.[3] ..... G03G 15/09

[52] U.S. Cl. ..... 355/3 DD; 355/14 D; 118/652; 118/658; 118/639; 430/120; 430/122

[58] Field of Search ..... 355/3 DD, 14 D, 3 BE; 118/652, 657, 658, 639; 430/120, 122, 123

[56] References Cited

U.S. PATENT DOCUMENTS 4,006,981 2/1977 Fantuzzo ..... 355/3 DD
4,162,842 7/1979 Wu ..... 355/3 DD
4,337,724 7/1982 Hosono et al. ..... 355/3 DD X
4,364,659 12/1982 Noda ..... 355/14 D
4,370,056 1/1983 Hays ..... 355/3 BE X

*Primary Examiner*—A. C. Prescott
*Attorney, Agent, or Firm*—James E. Nilles

[57] ABSTRACT

A magnetic-brush developing device wherein a rotary sleeve with permanent magnet incorporated therein is positioned inside a housing containing a developer, wherein the thickness of ears of developer formed on the peripheral surface of the rotary sleeve is regulated by a doctor blade, and wherein a rotor which forcibly removes surplus developer scraped off by the doctor blade is provided just in front of the doctor blade. The doctor blade regulating the thickness of ears of developer formed on the peripheral surface of the rotary sleeve with the permanent magnets incorporated therein is formed in the shape of a knife edge directed in the opposite direction to the direction of rotation of the rotary sleeve.

6 Claims, 3 Drawing Figures

PRIOR ART FIG. 1
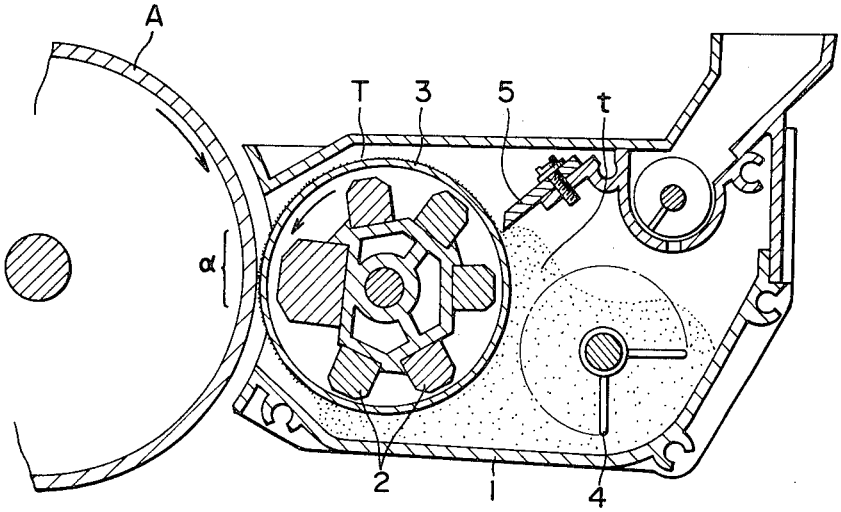
FIG. 2
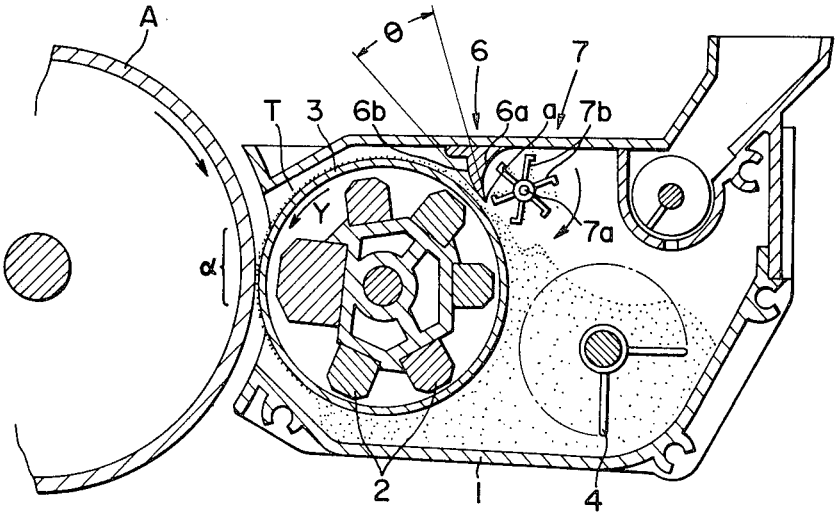

MAGNETIC-BRUSH DEVELOPING DEVICE

BACKGROUND OF THE INVENTION

1. Field of the Invention:

The present invention relates to a magnetic-brush developing device employed, for instance, in an electrophotographic reproduction apparatus or the like.

2. Description of the Prior Art:

The conventional magnetic-brush developing device has a structure such as that shown in FIG. 1, for instance. That is, a developer such as a one-component developer or a two-component developer is contained in a box-shaped housing 1, in which a rotary sleeve 3 wherein a plurality of permanent magnets 2 are incorporated is positioned facing the peripheral surface of a photosensitive drum A. An agitator blade 4 which agitates and mixes as well as frictionally electrifies the contained developer is provided inside said housing 1, as well as a doctor blade 5 is positioned in the vicinity of the peripheral surface of said rotary sleeve 3 and directed toward it at nearly a right angle. Accordingly, in a magnetic-brush developing device having such a structure, the ears of developer are shaped by the magnetic flux of the permanent magnets 2 and the rotation of the rotary sleeve 3, and the thickness of them is adjusted by the doctor blade 5 as they are conveyed to a developing area $\alpha$.

However, when the developer T is being conveyed, the surplus developer scraped off by the doctor blade 5 collects just in front of the doctor blade 5 as shown in the figure, and the pressure of this surplus developer t causes a large increase in the rotational torque of the rotary sleeve 3, the rapid deterioration of the developer T through its condensation or abrasion, and interruptions in the supply of ears of developer to the surface of the rotary sleeve 3 which causes striped faulty areas in the developed image. Such problems, which are often seen in conventional magnetic-brush units, are especially obvious when a minute-particle toner with a high insulation is employed, or in a high-speed magnetic-brush developing device wherein the quantity of developer being conveyed is large, which hinders high-resolution development and high-speed development.

SUMMARY OF THE INVENTION

The purpose of the present invention is to obtain a structure wherein the obstruction, as described above, caused by the developer collecting just in front of the doctor blade is removed, and to obtain a magnetic-brush developing device characterized in that a rotor which forcibly removes the surplus developer scraped off by the doctor blade is provided just in front of said doctor blade in type of magnetic-brush developing device wherein a rotary sleeve with permanent magnets incorporated therein is positioned inside the box-shaped housing containing the developer, and wherein the thickness of ears of developer formed on the peripheral surface of the rotary sleeve is regulated by a doctor blade.

Another purpose of the present invention is to obtain a magnetic-brush developing device characterized in that said doctor blade is formed in the shape of a knife edge directed in the opposite direction to the direction of rotation of the rotary sleeve, and in that the angle made by the two surfaces of said doctor blade is made acute.

The other purposes and characteristics of the present invention will be made clear with reference to the drawings.

BRIEF DESCRIPTION OF THE DRAWINGS

FIG. 1 is a sectional view of a conventional magnetic-brush developing device;

FIG. 2 is a sectional view of the magnetic-brush developing device of the present invention.

DESCRIPTION OF THE PREFERRED EMBODIMENTS

Figure 3:
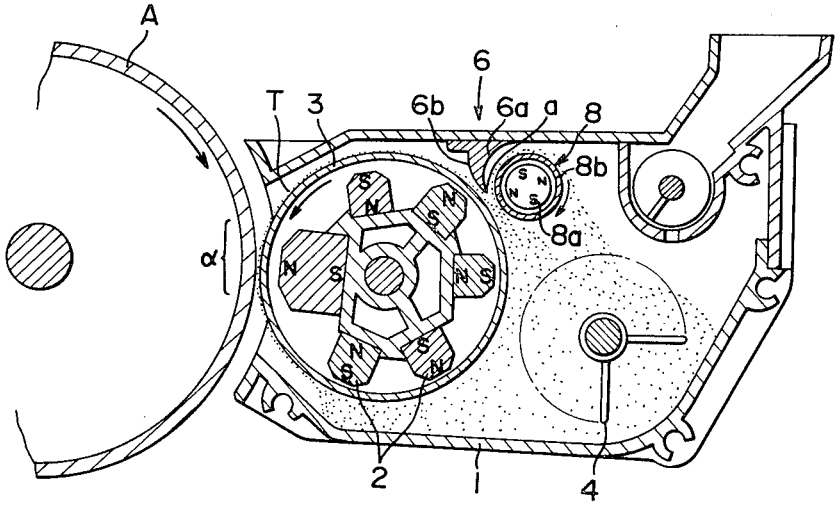
FIG. 3 is a sectional view of the magnetic-brush developing device of another embodiment of the present invention.

FIG. 2 illustrates a magnetic-brush developing device of the present invention. The characteristic features of the structure shown in FIG. 2 is a doctor blade 6 and a small rotor 7 positioned in the vicinity of the doctor blade 6. The doctor blade 6, which is preferably made of a nonmagnetic metal or a material which is close in the frictional electrification series to the developer, is formed in the shape of a knife edge whose edge is directed in the opposite direction to the direction of rotation Y of the rotary sleeve 3, while the two side surfaces 6*a* and 6*b* of the doctor blade 6 are formed as circular arcs and the angle formed between the tangents of the two surfaces 6*a* and 6*b* which meet at said edge a is made to be an angle smaller than 90 degrees, i.e. an acute angle. Accordingly, the surplus developer carried to the position of the doctor blade 6 by the rotation of the rotary sleeve 3 are scraped off as they pass the edge a of the doctor blade 6 so that a regulated thickness of developer is supplied to the developing area. The surplus developer scraped off by the doctor blade 6 is guided by the circular-arc surface 6*a* to drop into, and to be collected by, the housing 1.

The rotor 7, which is preferably made of a nonmagnetic metal or of a material which is close in the frictional electrification series to the developer in the same way as in said doctor blade 6, is formed in the shape of an impeller provided with a number of radiating arms 7*b* about a center shaft 7*a* which is at the center of curvature of said surface 6*a*, as shown in the figure, and is rotated at a circumferential speed higher than the speed of the ears of the developer on said rotary sleeve 3. According to circumstances, the rotor 7, which may be rotated in the reverse direction to that shown in the figure, does not need to be formed only in the shape of the impeller shown in the figure, but could also be embodied in such variations of form as a screw-conveyor shaped or elliptical rotor. Accordingly, the most of the surplus developer carried to just in front of the doctor blade 6 by the rotation of the rotary sleeve 3 are removed beforehand by the rotation of the rotor 7 before the rest moves to the doctor blade 6. Since the surplus developer scraped off when passing the doctor blade 6 is rapidly moved from the area around the edge a of the doctor blade 6 by the rotary motion of the rotor 7, no surplus developer collects at the doctor blade 6.

In the magnetic-brush developing device of the present invention, the rotor is positioned just in front of the doctor blade, the edge of the doctor blade is directed in the opposite direction to the direction of rotation of the rotary sleeve, and the angle formed by the two side surfaces of the doctor blade is made acute. Therefore, the present invention brings about the advantages that no developer collects around the doctor blade, that the rotational torque of the rotary sleeve can be reduced by half, that the lifetime of the developer can be prolonged and that, specially in a one-component development with which a high insulation toner is employed, the quantity of developer arriving at the developing area becomes uniform, resulting in no interruption in the supply of ears.

FIG. 3 illustrates a magnetic-brush developing device of another embodiment of the present invention in which a magnetic roller is used as a rotor. Reference numerals 1, 2, 3, 4 and 6 show parts similar to those in FIG. 2 and the explanations thereof are omitted.

Reference numeral 8 denotes a magnetic roller within which a stationary permanent magnet 8*a* having N poles and S poles and a nonmagnetic rotary sleeve 8*b* surrounding said magnet 8*a* are incorporated. The rotary sleeve 8*b* rotates in a direction indicated by an arrow.

The object of the present invention can also be attained by the developing device shown in FIG. 3.

Further, it is preferable that the angle $\theta$ formed by the two surfaces 6*a* and 6*b* of the doctor blade 6 is made within 30°–70°.

What is claimed is:

1. In a magnetic-brush developing device wherein a rotary sleeve with permanent magnet incorporated therein is positioned inside a housing containing a developer, and wherein the thickness of ears of developer formed on the peripheral surface of the rotary sleeve is regulated by a doctor blade, the improvement characterized in that a rotor which forcibly removes surplus developer scraped off by the doctor blade is provided just in front of said doctor blade.

2. The magnetic-brush developing device described in claim 1 which is characterized in that said doctor blade regulating the thickness of ears of developer formed on the peripheral surface of the rotary sleeve with the permanent magnets incorporated therein is formed in the shape of a knife edge directed in the opposite direction to the direction of rotation of the rotary sleeve.

3. The magnetic-brush developing device described in claim 2, wherein the angle formed by the two surfaces of said doctor blade is made acute.

4. The magnetic-brush developing device described in claim 3, wherein said angle is made within 30°–70°.

5. In a magnetic-brush developing device wherein a rotary sleeve with permanent magnet incorporated therein is positioned inside a housing containing a developer, and wherein the thickness of ears of developer formed on the peripheral surface of the rotary sleeve is regulated by a doctor blade, the improvement characterized in that said doctor blade is formed in the shape of a knife edge directed in the opposite direction to the direction of rotation of the rotary sleeve, and in that the angle formed by the two surfaces of said doctor blade is made acute.

6. The magnetic-brush developing device described in claim 5, wherein said angle is made within 30°–70°.

* * * * *